United States Patent [19]

Samuels

[11] 4,270,305

[45] Jun. 2, 1981

[54] TOY WHEELED VEHICLE

[75] Inventor: Donald H. Samuels, Warwick, R.I.

[73] Assignee: Hasbro Industries, Inc., Pawtucket, R.I.

[21] Appl. No.: 11,551

[22] Filed: Feb. 12, 1979

[51] Int. Cl.[3] ..... A63H 17/26

[52] U.S. Cl. ..... 46/221; 46/201

[58] Field of Search ..... 46/221, 223, 201; 35/72; 272/156, 157 R, 160, 276; 301/63 PW

[56] References Cited

U.S. PATENT DOCUMENTS

| | | | |
|---|---|---|---|
| 687,057 | 11/1901 | Parker | 46/221 |
| 2,398,223 | 4/1946 | Gilbert | 46/201 |
| 2,665,522 | 1/1954 | Junod | 46/221 |
| 2,948,055 | 8/1960 | Baxter et al. | 301/64 R |
| 3,280,499 | 10/1966 | Studen | 273/156 |
| 4,061,339 | 12/1977 | Coster | 46/223 |
| 4,193,639 | 3/1980 | Pauly et al. | 301/63 PW |

FOREIGN PATENT DOCUMENTS

| | | | |
|---|---|---|---|
| 246456 | 7/1911 | Fed. Rep. of Germany | 46/221 |
| 965885 | 9/1950 | France | 46/221 |

*Primary Examiner*—Gene Mancene
*Assistant Examiner*—John J. Wilson
*Attorney, Agent, or Firm*—Salter & Michaelson

[57] ABSTRACT

A toy wheeled vehicle having a plurality of wheel assemblies each of which includes an axle and a wheel. Each axle terminates in an enlarged flange having various respective geometric configurations. The generally cylindrical wheels include a radial web or wall having an opening disposed therethrough. The configuration of each wheel openings corresponds to one of the various geometric configurations of the axle such that each wheel is adapted for mounting only to its complementary shaped axle such that a child may learn shape coordination while assembling the vehicle for later conventional play.

3 Claims, 6 Drawing Figures

FIG. 1
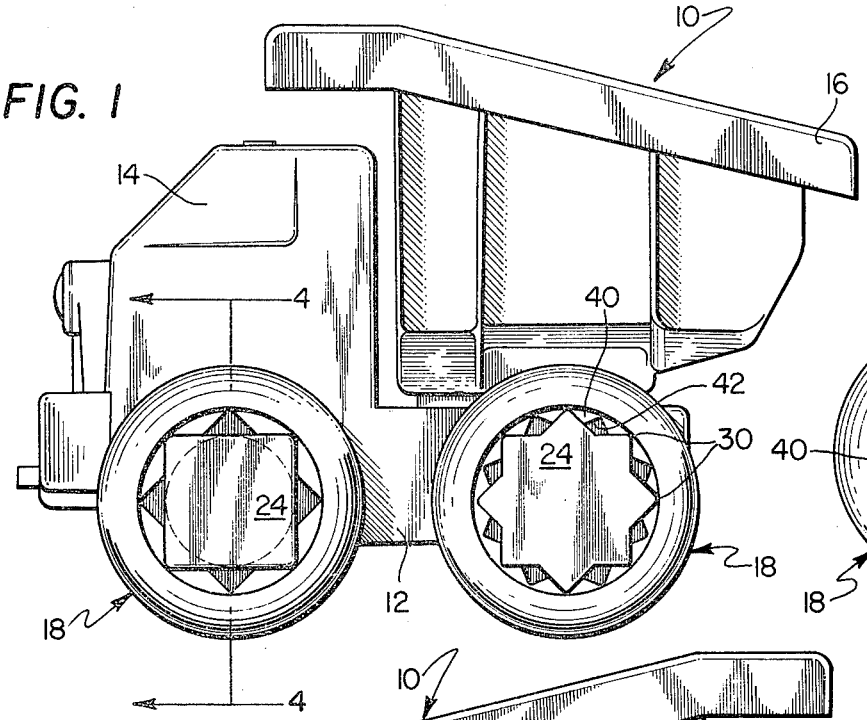
FIG. 3
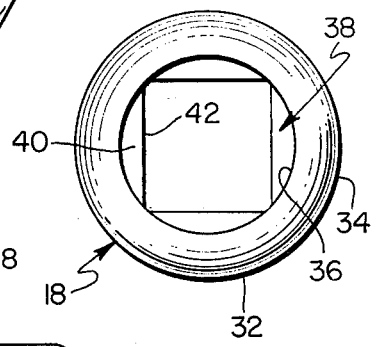
FIG. 2
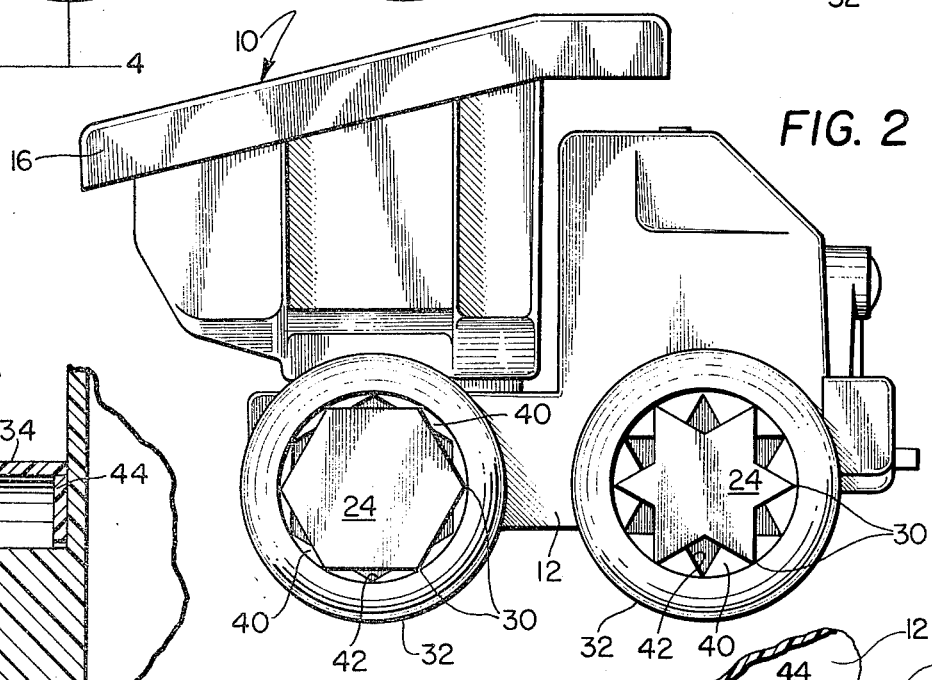
FIG. 4
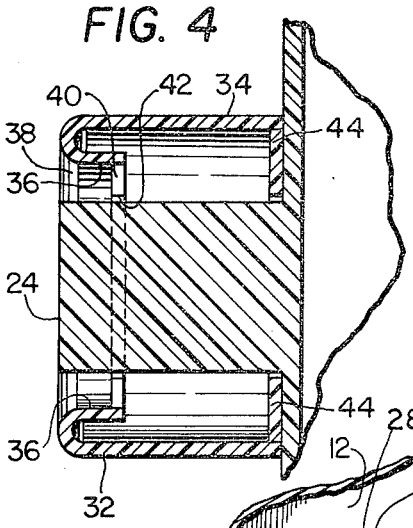
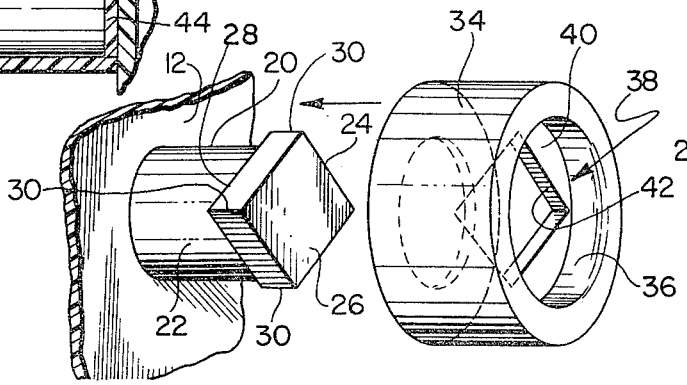
FIG. 5
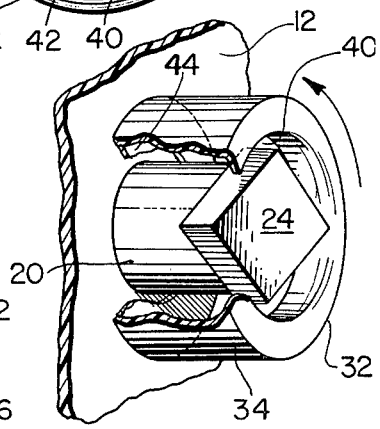
FIG. 6

TOY WHEELED VEHICLE

BACKGROUND AND SUMMARY OF THE INVENTION

This invention relates to a toy wheeled vehicle and more particularly to a unique wheel assembly for use in such toy vehicle. Such wheel assembly is so constructed such that in order to be assembled on the vehicle, it is necessary that the child coordinate predetermined geometric configurations with each other. In other words, the child must correctly coordinate a plurality of various geometric configurations with each other before the toy vehicle can be completely assembled for play.

Many toys function in such a manner that various shaped geometric objects are moved through similar shaped openings in order to complete the game object i.e., various blocks having different cross-sectional configurations are moved through appropriate slots or openings of similar configuration in order to place the blocks within a container. Games or devices of this nature generally have as their main object the coordination of various shapes so that the child may learn to recognize and coordinate such shapes yet at the same time engage in some pleasurable activity. Instead of making shape coordination the main feature of the device or game, if such shape coordination activity could be incorporated in a game or device having a different overall object, the play value of such game or device might be enhanced. It is accordingly a primary object of the present invention to provide such a game, device or activity in which shape coordination is an integral portion of the assembly of such a device such that the shape coordination activity is completed prior to use of the device itself in game or play activity.

A further object of the present invention is the incorporation of such aforementioned object into the environment of a toy wheeled vehicle in which wheel assemblies having different geometric characteristics must be assembled with regard to correct shape coordination prior to the mounting of the wheels upon such vehicle so that the vehicle can be used in conventional play activity.

These and other objects of the present invention are accomplished by a wheel assembly for a toy vehicle and the like comprising an axle having an outer portion of a predetermined geometric shape and a matching wheel easily mountable thereon and separable therefrom, as by a child, wherein the wheel includes an outer surface and a front annular recess terminating in a rearwardly offset wall having an opening therethrough corresponding in both size and shape to the predetermined shape of said axle outer portion. In this regard, the axle outer portion passes through the wall opening for disposition within the annular recess of the wall. Each of the wheels has a different geometrically shaped wall opening so as to match similarly shaped axles such that each of the wheels must be mounted upon its respectively similarly shaped axle in order to properly mount the wheels thereon.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention;

FIG. 1 is a side elevational view of a toy truck constructed in accordance with the present invention;

FIG. 2 is a similar side elevational view but taken from opposite side;

FIG. 3 is a elevational view of one of the wheels utilized in the present invention;

FIG. 4 is a cross-sectional view taken along the line 4—4 of FIG. 1 showing that wheel having a square opening as shown in FIG. 3 mounted upon a similarly shaped axle;

FIG. 5 is a partial perspective view prior to assembly of the wheel assembly shown in FIG. 4; and FIG. 6 is a perspective view of the assembled wheel assembly shown in FIGS. 4 and 5 with parts broken away for clarity.

DESCRIPTION OF THE INVENTION

FIGS. 1 and 2 show opposite sides of a toy truck 10. The truck 10 includes a body 12 including a cab portion 14 and a dump section 16. Obviously, the particular shape, style or type of truck or other vehicle of itself is not material to the present invention so long as the truck or other vehicle preferably provides actual play activity once the several wheel assemblies 18 have been properly attached thereto.

In that regard, each of the wheel assemblies 18 includes an axle 20 which may be integral with or otherwise conventionally attached to the body 12 of the truck. Each axle 20 (there are usually four but there may be fewer or more depending upon the style vehicle utilized) outwardly projects from the body 12 of the truck and includes a shaft portion 22 and an outer terminal flange 24 of a particular cross sectional geometric shape such as the square shown in FIGS. 3 through 6, the hexagonal and the six and eight-sided star configurations additionally shown in FIGS. 1 and 2. The flange 24 includes an outer surface or face 26, an opposite inner surface or face 28 (not fully visible) and a plurality of radially extending areas or circumferentially spaced points 30.

Each wheel assembly 18 further includes a wheel 32 of a generally cylindrical or toroidal shape having an outer supporting surface 34 which may be provided with a tread configuration and an inner axle supporting surface 36. The front of each wheel is provided with an inwardly projecting recess 38 generally equal to or slightly greater in depth than the axial thickness of the flange 24 such that the flange may be completely disposed or seated therein in a manner that will hereinafter be more fully brought out. The extent of the recess 38 is delineated by a web or wall 40 radially extending from the inner surface 36. The web includes a central opening 42 axially disposed therethrough of a configuration and size to permit the axle flange 24 to easily pass therethrough. Additionally, the wheel 32 may be provided with a rear wall 44 to impart further rigidity to the wheel and adapted to engage face portions of the body 12 to better stabilize the wheel as it rotates about the axle in use. Also, the rear wall 44 may, as shown, radially extend to the interior portions of the wheel and itself form the web or wall in which the opening 42 is disposed. In that regard it should also be pointed out that wall 44 may axially extend in such a manner to connect with surface 36 as when the wheel is blow molded to form a hollow annulus between surface 34 and wall 44.

In any case, the configuration of each particular opening 42 is matched for coordinated fit over at least one of the axle flanges 24. Normally, each axle flange 24 has a different geometric configuration and accordingly openings 42 of similar configurations are disposed in the several wheels 32, it being clear that a square opening is designed to fit over a square flange and a hexagonal or star shaped opening to respectively fit with hexagonal and star shaped axles. In the actual assembly or construction of the truck 10, the child takes each of the four wheels 32 and assemblies them over an axle flange 24 having the particular geometric configuration of that particular wheel opening until all the wheels are assembled on the truck. Then the child can play with the truck in a normal manner which enables the shape coordination activities of the game or device of the present invention to be part of a normal constructional activity rather than a means or aim in itself. This provides a more natural play environment for the child and enables him or her to learn while actually not regarding the learning task as such.

Returning now to the drawing, it should be pointed out that each wheel 32 must be properly oriented with respect to the particular axle which matches the particular geometric configuration of its opening such that the opening 42 thereof is aligned with the flange 24 such that flange 24 passes through the opening and into the recess 38. Thereafter, any relative rotation of the wheel 32 with respect to the axle misaligns the opening with respect to the flange 24 or vice-versa such that portions of the rear face 28 of the flange 24 are positioned adjacent the front face of the wall or web 40. Accordingly, the wheel 32 is retained on the axle 20 and may rotate with respect thereto in a normal manner such that the truck 10 may be conventionally rolled across a supporting surface. In such position the several points 30 of the flange 24 make supporting axial line contact with the inner axle supporting surface 36 of the wheel 32. Such contact insures that relatively smaller diameters of the shaft portion 22 of the axle 20 will not cause a sloppy fit between the axle and the wheel. Such line contact between the flange 24 and the wheel 32 at the several spaced peripheral points 30 also insures a relatively low degree of frictional contact between the axle and wheel of each wheel assembly 18.

Many other geometric configurations other than those specifically shown on the drawing may be utilized, including for instance triangular, oval or rectangular so long as portions of the flange provide radially extending spaced peripheral points which in turn provide rear surface portions 28 which can both overlap i.e., be disposed adjacent to face portions of the wall 40, so as to retain the various wheels upon the axles as they rotate in relationship thereto. An example of a non-operative geometric configuration would accordingly be a circle.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A wheel assembly for a toy vehicle and the like, comprising an axle having an outer portion of a predetermined non-circular geometric shape, and a matching wheel easily mountable thereon and separable therefrom, said wheel having an outer surface and a front annular recess defining an inner axle supporting surface and terminating in a rearwardly offset wall, said wall including an opening corresponding both in size and shape to the predetermined shape of said axle outer portion such that said axle outer portion may pass through said wall for disposition in said annular recess when said wheel is mounted to said axle and wherein said axle outer portion contacts said inner wheel surface so as to support said wheel thereon, said wheel assembly comprising a plurality of such assemblies mounted on said toy vehicle, at least two of such wheel assemblies being characterized by a different geometric shape wherein a child must match the wheel having a particular shape wall opening within the similarly shaped axle portion in order to mount said wheel assemblies upon said toy.

2. A wheel assembly for a toy vehicle and the like, comprising an axle having an outer portion of a predetermined geometric shape and a matching wheel easily mountable thereon and separable therefrom, said wheel having an outer surface and a front annular recess defining an inner axle supporting surface and terminating in a rearwardly offset wall, said wall including an opening corresponding both in size and shape to the predetermined shape of said axle outer portion such that said axle outer portion may pass through said wall for disposition in said annular recess when said wheel is mounted to said axle and wherein said axle outer portion contacts said inner wheel surface so as to support said wheel thereon, and wherein there are a plurality of such assemblies mounted on said toy vehicle, each such wheel assembly being characterized by a different geometric shape wherein a child must match the wheel having a particular shape wall opening with the similarly shaped axle portion in order to mount said wheel assemblies upon said toy.

3. A wheel assembly for a toy vehicle and the like, comprising an axle having an outer portion of a predetermined geometric shape and a matching wheel easily mountable thereon and separable therefrom, said wheel having an outer surface and a front annular recess defining an inner axle supporting surface and terminating in a rearwardly offset wall, said wall including an opening corresponding both in size and shape to the predetermined shape of said axle outer portion such that said axle outer portion may pass through said wall for disposition in said annular recess when said wheel is mounted to said axle and wherein said axle outer portion contacts said inner wheel surface so as to support said wheel thereon, said axle terminating in an enlarged flange which forms said predetermined shape, and wherein said opening in said wall radially extends to a plurality of spaced points proximal to said inner axle supporting surface of said wheel, and wherein there are a plurality of such assemblies mounted on said toy vehicle, each such wheel assembly being characterized by a different geometric shape wherein a child must match the wheel having a particular shape wall opening with the similarly shaped axle portion in order to mount said wheel assemblies upon said toy.

* * * * *